US005511990A

United States Patent [19]

Klemen

[11] Patent Number: 5,511,990

[45] Date of Patent: Apr. 30, 1996

[54] ELECTRICAL INTERFACE CONNECTOR ASSEMBLY

[75] Inventor: Donald Klemen, Carmel, Ind.

[73] Assignee: General Motors Corporation, Detroit, Mich.

[21] Appl. No.: 339,031

[22] Filed: Nov. 14, 1994

[51] Int. Cl.[6] ..... H01R 13/74

[52] U.S. Cl. ..... 439/559

[58] Field of Search ..... 439/559, 556, 439/548, 550, 563, 564

[56] References Cited

U.S. PATENT DOCUMENTS 3,725,849 4/1973 Becke ..... 439/550

5,201,673 4/1993 Minezawa et al. ..... 439/559

*Primary Examiner*—Gary F. Paumen

*Attorney, Agent, or Firm*—Donald F. Scherer

[57] ABSTRACT

An electrical interface connector assembly that prevents the intrusion of undesired substances and elements in the environment past the connector assembly. The connector assembly has a generally U-shaped receptacle that is incorporated in a housing that has first and second portions separable along opposed and mating parting faces. A supporting ledge extends along the receptacle, to receive a mounting flange that extends laterally outwardly from a shroud on the connector block. A seal-engaging ledge also extending along the receptacle in stepped relation relative to the supporting ledge. A sealing gasket overlies the mounting flange and the seal-engaging ledge, and a retainer plate is demountably secured to a closure face on the receptacle to compress the sealing gasket against the mounting flange and the seal-engaging ledge to preclude the admission of foreign materials between the mounting flange and the receptacle.

13 Claims, 5 Drawing Sheets

ELECTRICAL INTERFACE CONNECTOR ASSEMBLY

TECHNICAL FIELD

The present invention relates generally to an electrical connector assembly for electrically powered vehicles. More particularly, the present invention relates to a structural arrangement by which to secure an electrical interface connecting block within a receptacle provided in the motor housing of an electrical vehicle. Specifically, the present invention relates to a unique structure by which to seal the electrical interface connecting block within the receptacle in order to preclude undesirable substances or elements present in the environment from entering the housing of a motor in an electrically powered vehicle.

BACKGROUND OF THE INVENTION

The use of electrical interface connectors with motors for electrically powered vehicles is well known in the art. Prior electrical interface connector systems have utilized various methods of preventing undesirable substances, such as water or even corrosive elements, from entering the motor housing for proposed electrically powered vehicles. One method utilizes an O-ring strategically placed beneath the interface connector where it abuts the motor housing. Another method utilizes a connector gasket shaped precisely to match the underside of the connector body. Thus, a compressive seal is formed when the connector is secured to the motor housing with either an O-ring or a gasket disposed therebetween, and the compressive seal is utilized in an attempt to prevent the admission of undesirable substances or elements into the motor housing.

Although the aforementioned positioning of the gasket or O-ring performs adequately, such seals cannot be easily replaced once they become worn or damaged. Likewise, due to the location of the O-ring or gasket relative to the connector, it is difficult to determine if either have become damaged, thereby enhancing the probability of damage to components within the motor housing by virtue of any relatively undetectable damage to the sealing member.

While attempts have been made to provide an effective seal between an electrical interface connector and the associated motor housing, the art has not heretofore provided a facile arrangement by which an effective seal for the electrical interface connector can be easily assembled, monitored and maintained.

SUMMARY OF THE INVENTION

It is, therefore, a primary object of the present invention to provide a sealing assembly that is both easily assembled and maintained.

It is another object of the present invention to provide an electrical interface connector assembly, as above, that is not only reliable but also capable of being manufactured and assembled at an economically favorable cost, as measured in comparison to prior known assemblies.

It is yet another object of the present invention to provide an electrical interface connector assembly, as above, for a motor housing with a sealing gasket that is easily inspected.

It is still another object of the present invention to provide an electrical motor interface connector assembly, as above, that permits an adequate bending radius for wires leading to and from the interface connector.

It is yet another object of the present invention to provide an electrical interface connector assembly, as above, that permits an uncomplicated means by which to shield against electro-magnetic interference.

It is an even further object of the present invention to provide an electrical interface connector assembly, as above, that can only be mounted in one particular way with respect to the motor housing, thereby precluding inadvertent reversal of the interface connector block.

These and other objects of the invention, as well as the advantages thereof over existing and prior art forms, which will be apparent in view of the following detailed specification, are accomplished by means hereinafter described and claimed.

In general, the present invention relates to an electrical connector interface that prevents the intrusion of undesired substances and elements in the environment past the connector assembly. The connector assembly has a generally U-shaped receptacle that is incorporated in a housing that has first and second portions separable along opposed and mating parting faces. A supporting ledge extends along the receptacle, to receive a mounting flange that extends laterally outwardly from a shroud on the connector block. A seal-engaging ledge also extends along the receptacle in stepped relation relative to the supporting ledge. A sealing gasket overlies the mounting flange and the seal-engaging ledge, and a retainer plate is demountably secured to a closure face on the receptacle to compress the sealing gasket against the mounting flange and the seal-engaging ledge to preclude the admission of foreign materials between the mounting flange and the receptacle.

To acquaint persons skilled in the arts most closely related to the present invention, one preferred embodiment of an electrical interface connector assembly that illustrates a best mode now contemplated for putting the invention into practice is described herein by, and with reference to, the annexed drawings that form a part of the specification. The exemplary electrical interface connector assembly is described in detail without attempting to show all of the various forms and modifications in which the invention might be embodied. As such, the embodiment shown and described herein is illustrative and, as will become apparent to those skilled in these arts, can be modified in numerous ways within the spirit and scope of the invention; the invention being measured by the appended claims and not by the details of the specification.

DESCRIPTION OF AN EXEMPLARY EMBODIMENT

Figure 1:
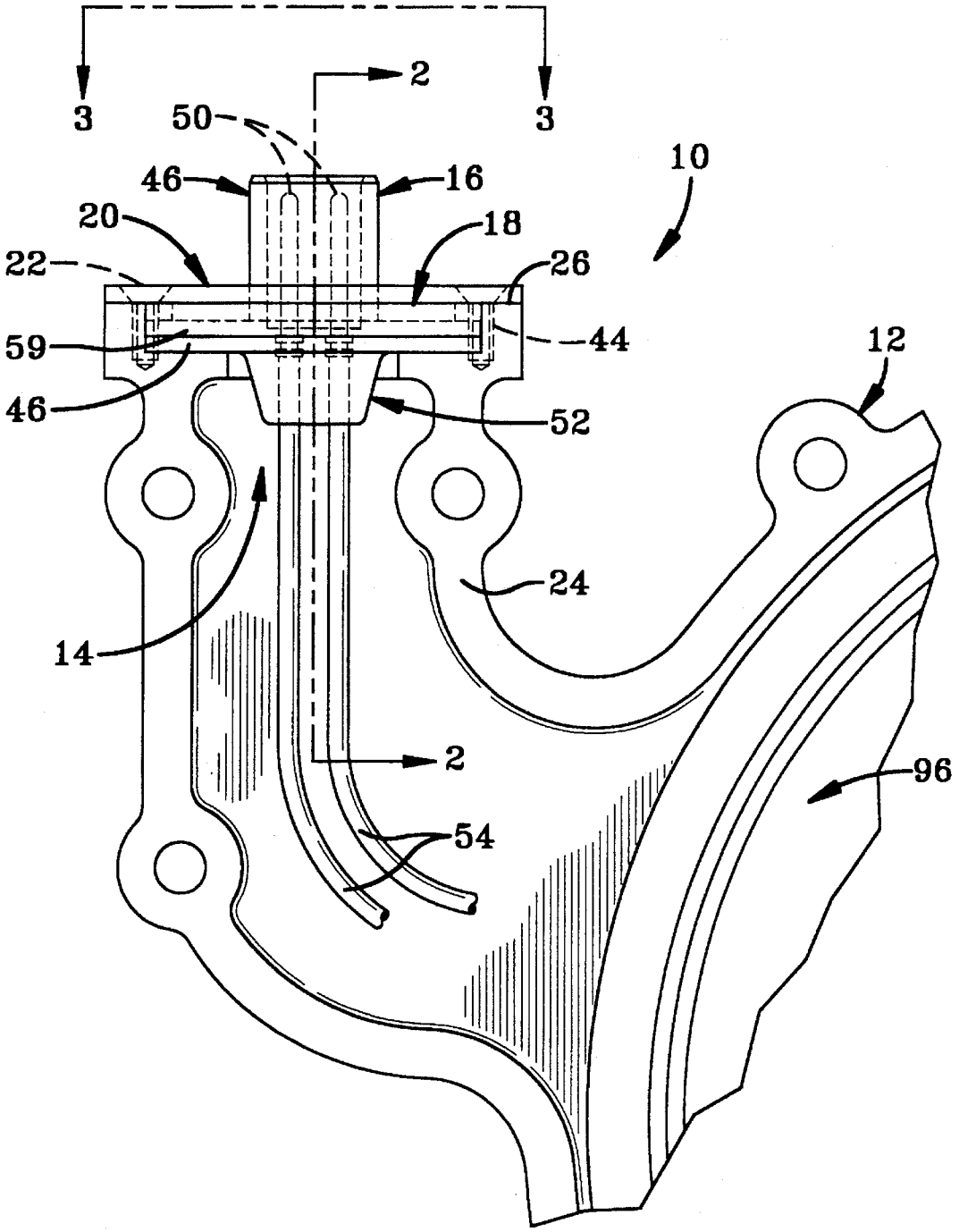
FIG. 1 is an elevational view taken along the parting face of one portion of an electrical motor housing that is provided with a receptacle portion adapted to receive the remaining components of an electrical interface connector assembly embodying the concepts of the present invention.
Figure 3:
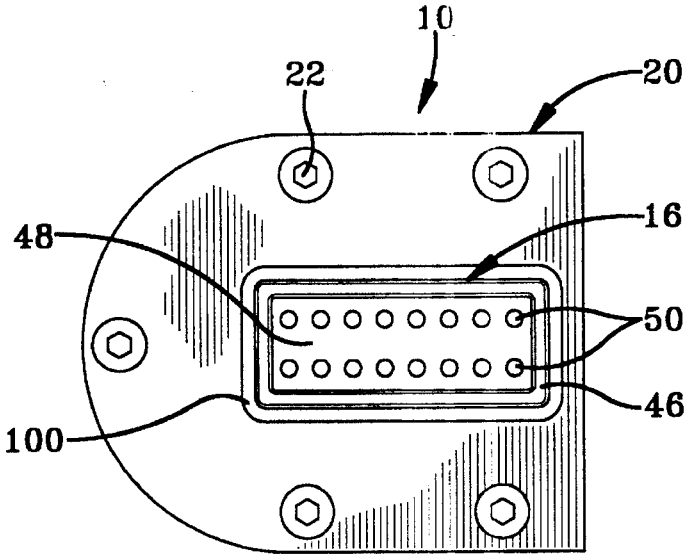
FIG. 3 is an enlarged top plan view taken substantially along line 3—3 of FIG. 1.

One representative form of an electrical interface connector assembly embodying the concepts of the present invention is designated generally by the numeral 10 on the accompanying drawings. With reference to FIG. 1, the representative electrical interface connector assembly 10 provides an effective barrier to substances or elements present in the environment that might, if entry were not denied, damage components contained within a motor housing, one portion of which is designated at 12. As shown, the electrical interface connector assembly 10 includes a uniquely configured receptacle 14 that may be integrally formed with the first housing portion 12. The details of the receptacle are best seen in FIG. 5.

An electrical interface connector block 16 is received within the receptacle 14, and a sealing gasket 18 overlies the connector block 16 to be secured in position by a retainer plate 20 that is secured to the receptacle 14, as by fastening means in the nature of screws 22.

Figure 4:
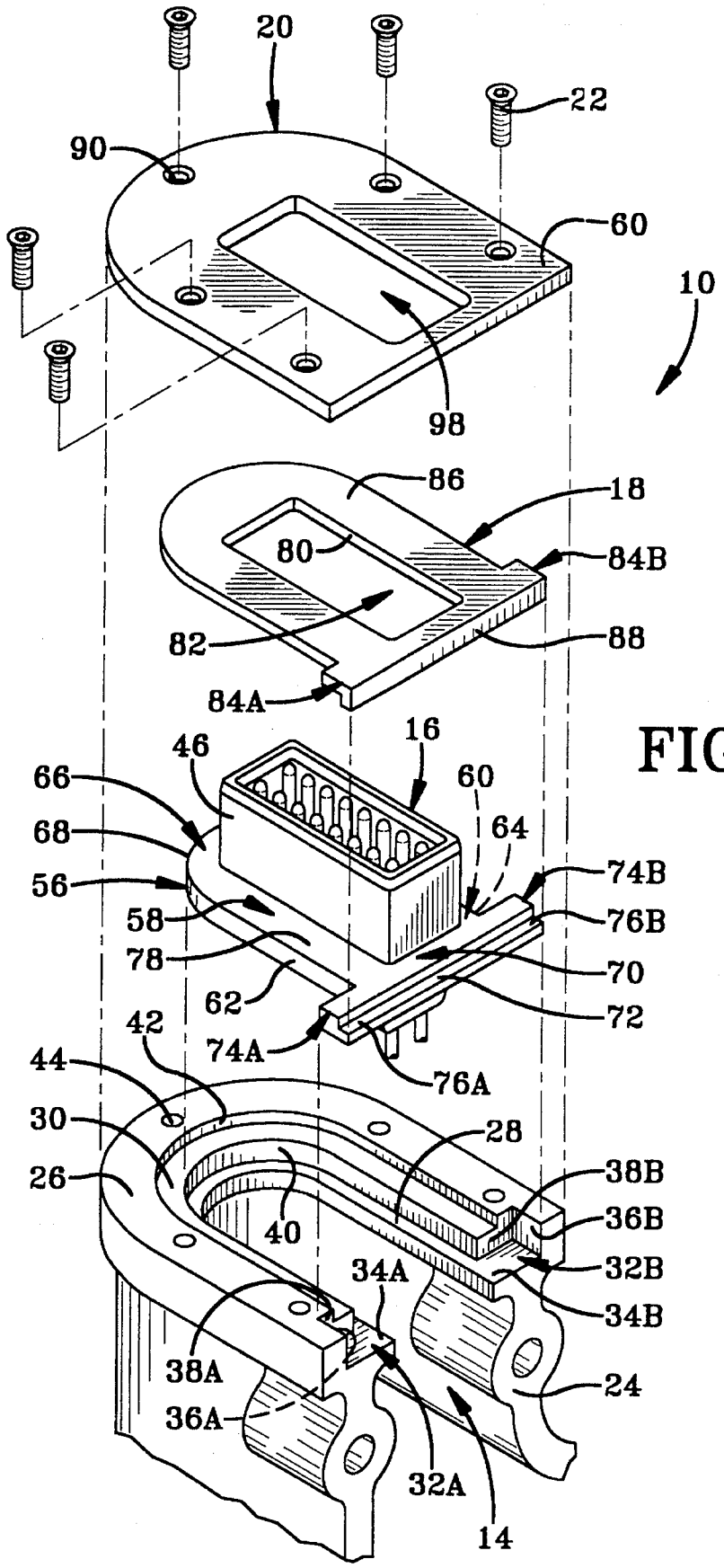
FIG. 4 is an exploded perspective of the electrical interface connector assembly depicted in the previous figures.
Figure 5:
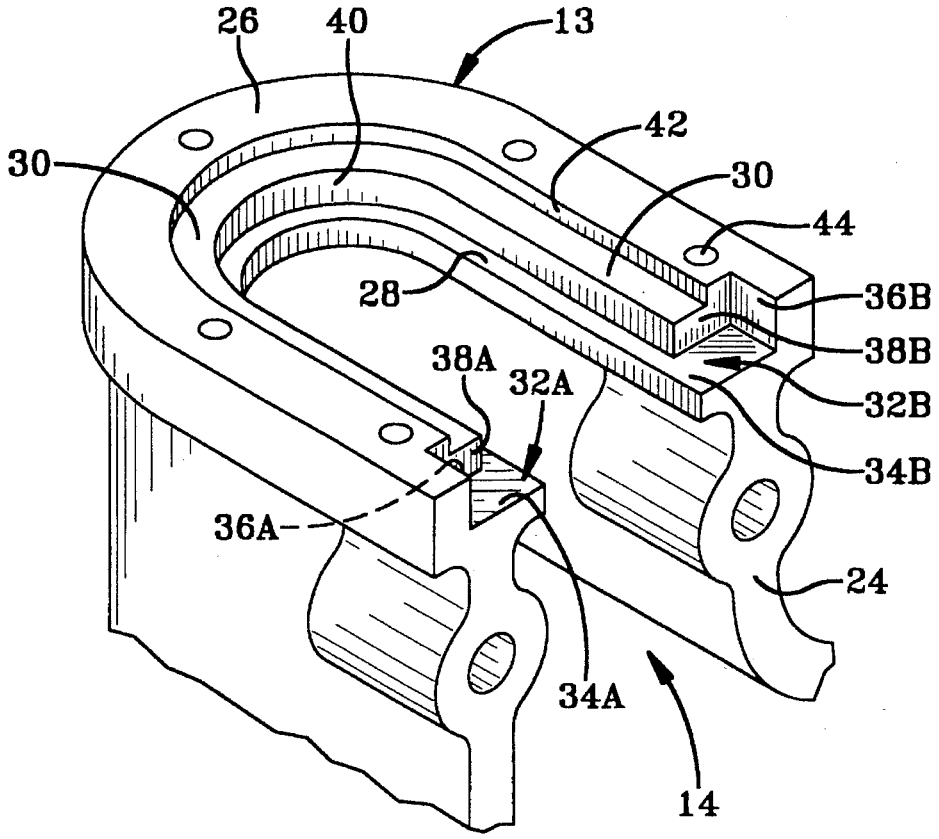
FIG. 5 is an enlarged perspective depicting the electrical interface receptacle represented in FIG. 4.
Figure 8:
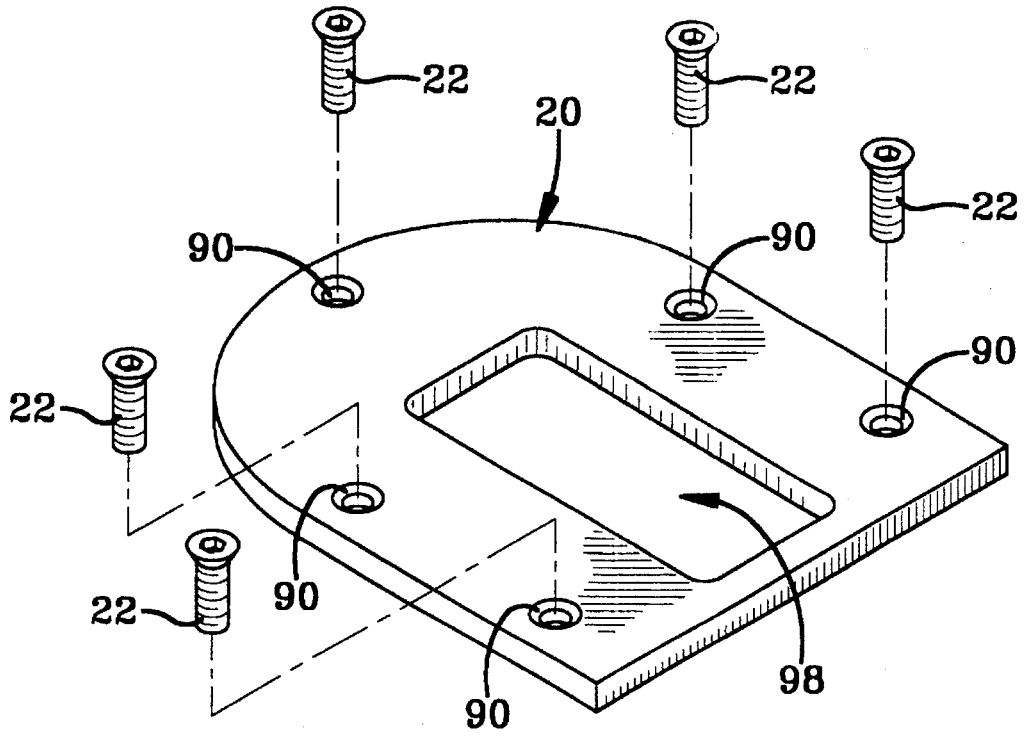

As is best observed from FIGS. 4 and 5, the receptacle 14 extends outwardly from the parting face 24 on motor housing portion 12 in a substantially U-shaped configuration, when viewed in plan. The upper extremity of the receptacle 14 is delineated by the closure face 26 that may preferably be disposed at right angles to the parting face 24. A pair of offset steps follow the U-shaped configuration of the closure face 26. Specifically, the lowest step comprises a connector block supporting ledge 28, and the intermediate step comprises a seal-engaging ledge 30. The upper step, therefore, is the closure face 26. A pair of opposed positioning notches 32A and 32B are located at the juncture of the receptacle 14 with the parting face 24 on the motor housing portion 12. The positioning notches 32 extend laterally of the steps and, in fact, the base 34 of each notch 32 preferably lies in the same plane as the connecting block supporting ledge 28.

As previewed in the previous paragraph, and as will appear in the detailed description which follows, a particular structural member, component or arrangement may be employed at more than one location. When referring generally to that type of structural member, component or arrangement, a common numerical designation shall be employed. However, when one of the structural members, components or arrangements so identified is to be individually identified, it shall be referenced by virtue of a letter suffix employed in combination with the numerical designation employed for general identification of that structural member, component or arrangement. Thus, there are at least two notches which are generally identified by the numeral 32, but the specific individual notches are, therefore, identified as 32A and 32B in the specification and on the drawings. This same suffix convention shall be employed throughout the specification.

The end wall 36 of each notch 32 preferably extends perpendicularly upwardly of the base 34 and terminates at the closure face 26. The side wall 38 of each notch 32 may also extend perpendicularly upwardly from the base 34 and preferably intersects the end wall 36 at a right angle. As such, the side wall 38 of each notch 32 intersects both the seal-engaging ledge 30 and the closure face 26 as well as the first riser 40 that extends upwardly between the supporting ledge 28 and the seal engaging ledge 30. The side wall 38 also intersects the second riser 42 that extends upwardly between the seal-engaging ledge 30 and the closure face 26.

A plurality of threaded bores 44 may be provided on the closure face 26 to receive the screws 22 that secure the retainer plate 20 to the receptacle 14, as will be hereinafter more fully described.

Figure 6:
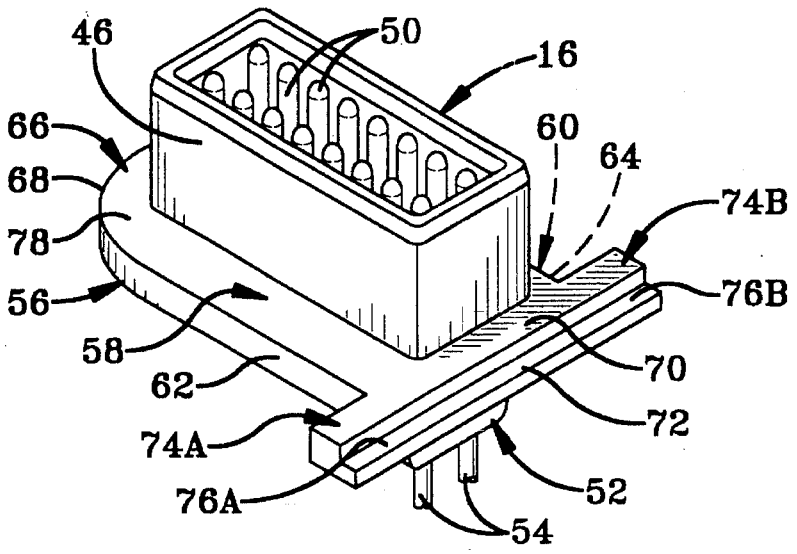
FIG. 6 is an enlarged perspective depicting a representative electrical interface connector block of the type represented in FIG. 4.

With more particular attention to FIGS. 4 and 6, it can be observed that the electrical interface connecting block 16 has a body portion in the shape of a rectangular shroud 46. A web wall 48 (FIG. 2) extends transversely within the hollow cavity delineated by the shroud 46, and a plurality of electrical transfer pin connectors 50 are mounted from the web wall 48 to receive the connector plugs 52 which are insertably received within opposite ends of the shroud 46 and by which an electrical connection is made between a plurality of wires 54 and the appropriate electrical transfer, pin connectors 50, as is well known to the art.

A mounting flange 56 extends transversely outwardly from the shroud 46 matingly to engage the supporting ledge 28. As such, the two side portions 58 and 60 of the mounting flange 56 have linear outer edges 62 and 64, respectively. The end portion 66 of the mounting flange 56 has an arcuate outer edge 68, and the other end portion 70 of the mounting flange 56 incorporates a linear recess 72 that is disposed in opposition to the parting face 92 on the second housing portion 102.

A pair of locating horns 74, in turn, extend outwardly from the end portion 70 of the mounting flange 56 in alignment therewith such that first and second extensions 76A and 76B of the linear recess 72 on the edge of the end portion 70 continue along the respective edges of the locating horns 74A and 74B.

Figure 7:
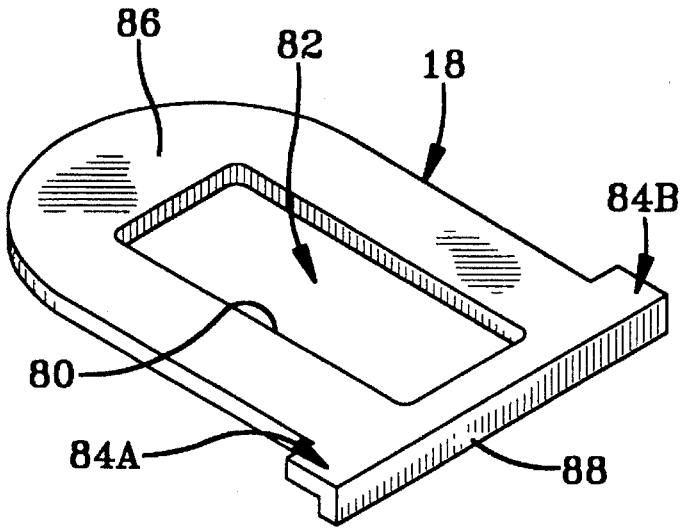
FIG. 7 is an enlarged perspective depicting a sealing gasket of the type represented in FIG. 4; and, FIG. 8 is an enlarged perspective depicting a retaining plate of the type represented in FIG. 4.

With more particular attention to FIGS. 4 and 7, the sealing gasket 18 conforms to the upper surface 78 of the mounting flange 56 on the electrical interface connector block 16 as well as the seal-engaging ledge 30. Accordingly, the peripheral edge 80 of a central aperture 82 in the sealing gasket 18 conforms to the exterior outline of the shroud 46. A pair of shoulders 84A and 84B project in opposite directions from the planar body portion 86 of the sealing gasket 18 to rest on the upper surface of the respective locating horns 74A and 74B as well as the coplanar upper surface on the end portion 70 of the mounting flange 56.

To facilitate the seal to be achieved by gasket 18, the stepped dimension of the first riser 40 is preferably selected to be substantially equal to the corresponding dimension—i.e.: the thickness—of the mounting flange 56. Similarly, the stepped dimension of the second riser 42 is preferably selected to be modestly less than the thickness of the sealing gasket 18. The relative dimensions of the second riser 42 and the sealing gasket 18 are selected so that when the retainer plate 20 is secured to the closure face 26, the sealing gasket 18 is firmly compressed against the mounting flange 56 and the seal-engaging ledge 30.

A compression lip 88 extends downwardly from the body portion 86 of the sealing gasket 18 along the edge of the shoulders 84 and the planar body portion 86 to be received within the linear recess 72 and the extensions 76 thereof for a purpose that will be more fully hereinafter apparent. For the present, it will be sufficient to note that the angular relation of the compression lip 88 with respect to the planar body portion 86 of the sealing gasket 18 creates an L-shaped configuration for the sealing gasket 18.

The retainer plate 20 has a plurality of bores 90 that are substantially aligned with the threaded bores 44 in the closure face 26 to permit the unimpeded passage of the screws 22 therethrough when the retainer plate 20 is secured to the closure face 26 of the receptacle 14 by the screws 22.

Figure 2:
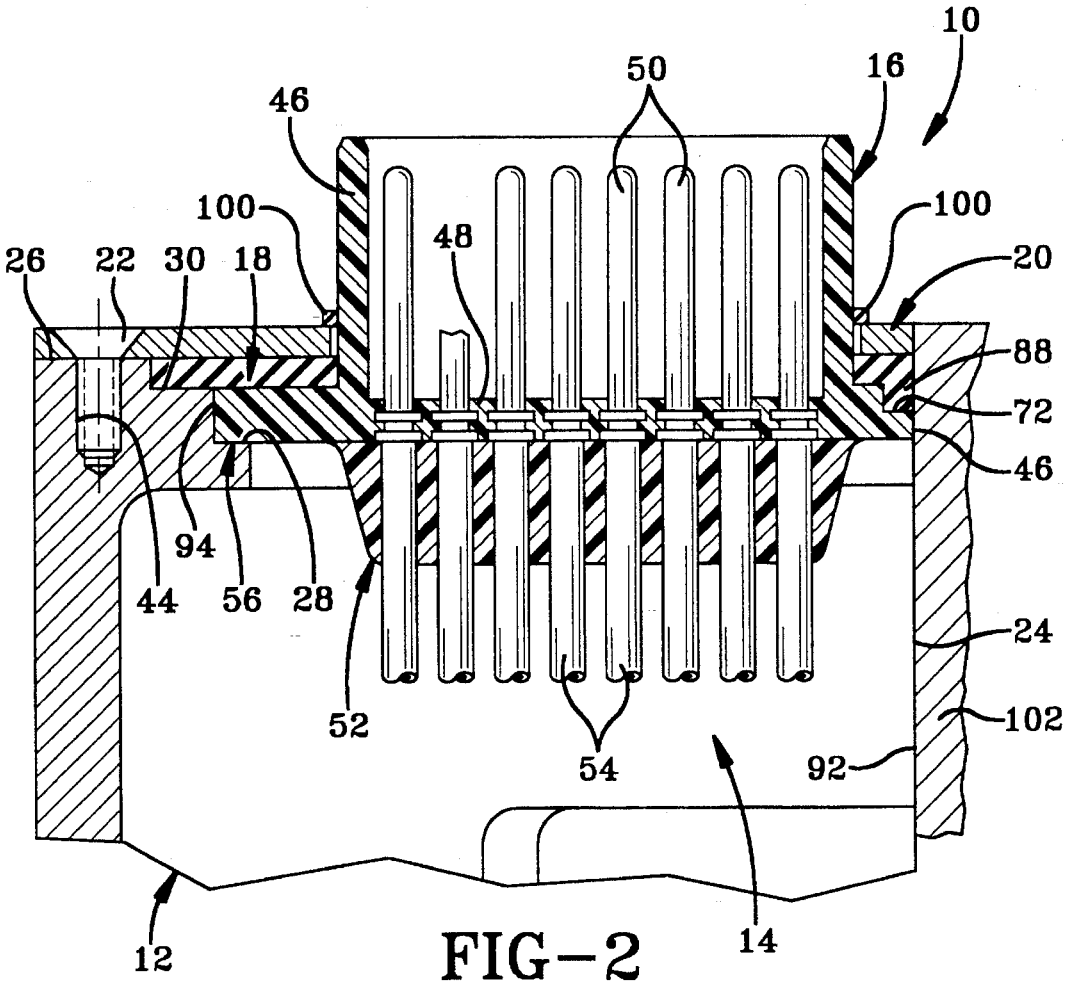
FIG. 2 is an enlarged vertical section taken substantially along line 2—2 of FIG. 1.

With the retainer plate 20—which, in the preferred embodiment, may be made of steel—secured in position by the screws 22, the electrical interface connecting block 16 will drive the lip 88—which is disposed in contiguous juxtaposition with the opposed parting face 92— thereagainst. As shown in FIG. 2, the parting face 92 on the second portion 102 of the casing opposes the parting face 24 on the first portion 12 of the casing for mating engagement. The planar body portion 86 will simultaneously and forcefully overlie the juncture 94 between the mounting flange 56 and the seal-engaging face 30. The thickness of the body portion 86 is selected to preclude the entry of environmental substances or elements between the retainer plate 20 and the closure face 26. As the screws 22 are tightened, they force the retainer plate 20 down upon the L-shaped sealing gasket 18 to compress the entire L-shaped gasket into any open areas adjacent thereto and thereby fully close and seal any and all crevices. This action creates a most effective seal so that environmental substances and elements will be barred from entering the cavity 96 within the housing.

Thus, the unique location and configuration of the sealing gasket 18, in combination with the associated structure of the interface connector assembly 10, precludes entry of undesired substances or elements into the motor cavity 96 or within the receptacle 14.

Although the gasket 50 can be made of any polymeric material, VITON brand rubber with a ten percent (10%) to twenty-five percent (25%) compression range has been found to be particularly successful.

Referring once more to FIGS. 1 and 4, it can be seen that the retainer plate 20 is disposed to cover the receptacle 14, but with particular reference to FIG. 2, the shroud-receiving opening 98 in the retainer plate 20 is slightly larger than the shroud 46. To further assist in sealing the electrical interface connector assembly 10, as shown in FIG. 2, an electromagnetic interference (EMI) gasket 100 may be disposed around the junction of the shroud 46 and the shroud-receiving opening 98 in the retainer plate 20. The EMI gasket 100 serves two functions. First, the EMI gasket 100 will absorb any extraneous electrical signals that could interfere with the operation of the electric motor (not shown). Second, the EMI gasket 100 also functions as an additional barrier to prevent environmental substances or elements from entering the motor cavity 98. The EMI gasket 100 may have an adhesive backing so that it may be secured to the surface to which it is applied.

To further reduce the problems associated with electromagnetic interference, the shroud 46 of the electrical interface connector block 16 may be metallized.

An additional feature of the electrical interface connector assembly 10 is shown in FIG. 1. As a result of the unique configuration of the electrical interface connector assembly 10, the wires 54 are permitted to follow a gentle bend radius so that they are not unduly stressed, even when connected to components (not shown) within the motor housing.

While only a preferred embodiment of the present invention is disclosed, it is to be clearly understood that the same is susceptible to numerous changes apparent to one skilled in the art. Therefore, the scope of the present invention is not to be limited to the details shown and described but is intended to include all changes and modifications which come within the scope of the appended claims.

As should now be apparent, the present invention not only teaches that an electrical interface connector assembly embodying the concepts of the present invention is easily assembled, monitored and maintained as well as accomplishing the other objects of the invention.

The embodiments of the invention in which an exclusive property or privilege is claimed are defined as follows:

1. An electrical interface connector assembly for a vehicle, said connector assembly comprising:

a housing;

said housing having first and second portions separable along opposed and mating parting faces and a closure face;

a generally U-shaped receptacle incorporated in one of said housing portions;

said receptacle extending outwardly from said parting face on said first housing portion;

a supporting ledge extending along said generally U-shaped receptacle;

an electrical interface connector block;

a mounting flange extending outwardly of said electrical interface connector block to be received on said supporting ledge;

a seal-engaging ledge also extending along said generally U-shaped receptacle in stepped relation relative to said supporting ledge;

a sealing gasket overlying said mounting flange and said seal-engaging ledge; and, a retainer plate demountably secured to said receptacle to compress said sealing gasket against said mounting flange and said seal-engaging ledge to preclude admission of foreign materials between said mounting flange and said receptacle.

2. An electrical interface connector assembly, as set forth in claim 1, further comprising:

a first riser extending between said supporting ledge and said seal-engaging ledge;

a stepped dimension of said first riser between said supporting ledge and said seal-engaging ledge being substantially equal to a corresponding dimension of said mounting flange.

3. An electrical interface connector assembly, as set forth in claim 2, further comprising:

a juncture defined between said mounting flange and said first riser;

said sealing gasket sealing said juncture when said sealing gasket is compressed by said retainer plate.

4. An electrical interface connector assembly, as set forth in claim 2, further comprising:

a second riser extending between said seal-engaging ledge and said closure face;

a stepped dimension of said second riser between said seal-engaging ledge and said closure face being related to the thickness of said sealing gasket such that securing said retainer plate on said closure face compresses said sealing gasket against said mounting flange and said seal-engaging ledge.

5. An electrical interface connector assembly, as set forth in claim 1, further comprising:

a recess in said mounting flange;

said recess being disposed in opposition to the parting face on said second housing portion;

a compression lip on said sealing gasket being received within said recess in contiguous juxtaposition to said opposed parting face on said second housing portion such that securing said retainer plate on said closure face compresses said lip between said recess and said opposed parting face on said second housing portion.

6. An electrical interface connector assembly, as set forth in claim 1, further comprising:

at least one positioning notch extending laterally of said receptacle in contiguous juxtaposition to said parting face;

a locating horn extending laterally of said mounting flange to be received in said positioning notch.

7. An electrical interface connector assembly, as set forth in claim 6, further comprising:

a first riser extending between said supporting ledge and said seal-engaging ledge;

a stepped dimension of said first riser between said supporting ledge and said seal-engaging ledge being substantially equal to a corresponding dimension of said mounting flange;

a second riser extending between said seal-engaging ledge and said closure face;

a stepped dimension of said second riser between said seal-engaging ledge and said closure face being related to a thickness of said sealing gasket such that securing said retainer plate on said closure face compresses said sealing gasket against said mounting flange and said seal-engaging ledge.

8. An electrical interface connector assembly, as set forth in claim 7, further comprising:

a recess in said mounting flange;

said recess extending linearly onto said locating horn and being disposed in opposition to the parting face on said second housing portion;

a compression lip on said sealing gasket being received within said recess in contiguous juxtaposition to said opposed parting face on said second housing portion such that securing said retainer plate on said parting face compresses said lip between said recess and said opposed parting face on said second housing portion.

9. An electrical interface connector assembly, as set forth in claim 8, further comprising:

a shroud on said electrical interface connector block;

a central aperture penetrating said sealing gasket and adapted to surround said shroud;

a shroud-receiving opening in said retainer plate to permit said retainer plate to overlie said sealing gasket.

10. An electrical interface connector assembly, as set forth in claim 9, wherein:

said sealing gasket is made of VITON.

11. An electrical interface connector assembly, as set forth in claim 10, further comprising:

an electro-magnetic interference gasket interposed between said retainer plate and said shroud.

12. An electrical interface connector assembly, as set forth in claim 11, wherein:

said shroud is metallized.

13. An electrical interface connector assembly, as set forth in claim 9, further comprising:

a plurality of electrical pin connectors provided within said shroud to receive at least one connector plug attached to one or more wires;

said connector plug being positioned in the housing such that any wire attached thereto is not unduly stressed when connected to said pin connectors.

* * * * *